US006483237B2

(12) United States Patent
Eastlund et al.

(10) Patent No.: US 6,483,237 B2
(45) Date of Patent: Nov. 19, 2002

(54) HIGH INTENSITY DISCHARGE LAMP WITH SINGLE CRYSTAL SAPPHIRE ENVELOPE

(75) Inventors: Bernard J. Eastlund, La Jolla, CA (US); Maurice E. Levis, Hallieford, VA (US)

(73) Assignee: Gem Lighting LLC, Manakin-Sabot, VA (US)

( * ) Notice: Subject to any disclaimer, the term of this patent is extended or adjusted under 35 U.S.C. 154(b) by 0 days.

(21) Appl. No.: 10/058,666

(22) Filed: Jan. 28, 2002

(65) Prior Publication Data

US 2002/0070668 A1 Jun. 13, 2002

Related U.S. Application Data

(63) Continuation of application No. 09/969,903, filed on Oct. 2, 2001, which is a continuation of application No. 09/241,011, filed on Feb. 1, 1999, now Pat. No. 6,414,436.

(51) Int. Cl.[7] ..... H01J 61/34

(52) U.S. Cl. ..... 313/570; 313/634; 313/636

(58) Field of Search ..... 313/567, 568, 313/570, 571, 572, 573, 634, 636, 637, 638, 639

(56) References Cited

U.S. PATENT DOCUMENTS

| | | | |
|---|---|---|---|
| 3,608,050 | A | 9/1971 | Carman et al. |
| 4,018,374 | A | 4/1977 | Lee et al. |
| 4,501,993 | A | 2/1985 | Mueller et al. |
| 4,855,879 | A | 8/1989 | Soltani et al. |
| 5,075,587 | A | 12/1991 | Pabst et al. |
| 5,239,230 | A | 8/1993 | Mathews et al. |
| 5,404,076 | A | 4/1995 | Dolan et al. |
| 5,424,608 | A | 6/1995 | Juengst et al. |
| 5,451,553 | A | 9/1995 | Scott et al. |
| 5,455,480 | A | 10/1995 | Bastian et al. |
| 5,497,049 | A | 3/1996 | Fischer |
| 5,702,654 | A | 12/1997 | Chen et al. |
| 5,829,858 | A | 11/1998 | Levis et al. |
| 6,137,230 | A | 10/2000 | Born et al. |
| 6,147,453 | A | 11/2000 | Geijtenbeek et al. |
| 6,181,053 | B1 | 1/2001 | Roberts |
| 6,200,005 | B1 | 3/2001 | Roberts et al. |
| 6,215,254 | B1 | 4/2001 | Honda et al. |
| 6,249,086 | B1 | 6/2001 | Honda et al. |
| 6,259,205 | B1 | 7/2001 | Wijenberg et al. |
| 6,274,982 | B1 | 8/2001 | Scott et al. |
| 6,281,629 | B1 | 8/2001 | Tanaka et al. |
| 6,285,131 | B1 | 9/2001 | Kiss et al. |
| 6,294,871 | B1 | 9/2001 | Scott et al. |
| 6,300,729 | B1 | 10/2001 | Keijser et al. |
| 6,316,867 | B1 | 11/2001 | Roberts et al. |

OTHER PUBLICATIONS

S. Carleton et al., "Metal Halide Lamps with Ceramic Envelopes: A Breakthough in Color Control," Journal of the Illuminating Engineering Society, Winter 1997, pp. 139–145.

S.A.R. Rigten, General Electric, Co. J. G.E.C. Journal, vol. 32, No. 1, 1965, pp. 50–51.

*Primary Examiner*—Frank G. Font
*Assistant Examiner*—Andrew H. Lee
(74) *Attorney, Agent, or Firm*—Fay Kaplun & Marcin LLP

(57) ABSTRACT

A high intensity discharge lamp constructed with a tubular envelope composed of single crystal sapphire in which a continuous non-flash arc is created across multiple electrodes to generate a radiation emitting plasma. The lamp may operate at higher temperatures and pressures than conventional high intensity discharge lamps to produce greater luminance at any given power input. The lamp fill may be chosen from a wide range of gases and additives to produce the desired light spectra in the range from ultraviolet through near infra-red. The effective life of the lamp may be significantly extended. The lamp may be utilized particular benefits in image projection where a small powerful light source is required to optically match increasingly smaller image generation devices. In particular, the lamp may maintain a pre-selected correlated color temperature from 4,000 to 9,000° K over the life of the lamp. Alternatively, the lamp may be operated without electrodes utilizing microwave or radio frequency radiation as a power source.

38 Claims, 7 Drawing Sheets

$Tinnerwallsapphire_i = deltaT2_i + 273 \cdot K + Touterwall_i$ $Tmaxquartz_i = 1170 \cdot K$ $Tmaxsapphire_i = 1400 \cdot K$

HIGH INTENSITY DISCHARGE LAMP WITH SINGLE CRYSTAL SAPPHIRE ENVELOPE

RELATED APPLICATIONS

This application claims the benefit of U.S. patent application Ser. No. 09/969,903 filed Oct. 2, 2001 still pending and entitled "Sapphire High Intensity Discharge Projector Lamp" which is a continuation of U.S. patent application Ser. No. 09/241,011 filed on Feb. 1, 1999 now U.S. Pat. No. 6,414,436 and entitled "Sapphire High Intensity Discharge Projector Lamp". Both applications are expressly incorporated herein, in their entireties, by reference.

FIELD OF INVENTION

The present invention relates to a high intensity discharge lamp that produces a radiation spectrum suitable for various applications, such as image projection, automotive, medical, communications (optical fibers) and general lighting applications.

BACKGROUND INFORMATION

Image projection is one of the major fields of application for visible light generated by a high intensity discharge ("HID") lamp. The conventional HID lamp optimized for visible light has major attributes that render it particularly suitable for use in image projection. Such HID lamp typically emits light from a plasma arc formed inside an envelope between two electrodes which are spaced a particular distance apart. The radiation spectrum of the light emitted from the HID lamp depends on the gases and other materials contained within the lamp (the "fill"). In a conventional projection system, the light from the lamp is collected via a series of optical elements and projected through an image gate onto a screen to form a projected image. The element which forms the image at the image gate can be film or any type of a light modulator, e.g., liquid crystal displays ("LCD"), digital micro-mirror devices ("DMD") or liquid crystal on silicon displays ("LCoS"). In image projection applications, the utility of the HID lamp may be defined by its optical efficiency, power efficiency, color rendition, arc stability (absence of "flicker"), arc gap, physical size, initial cost, operating cost, and overall system cost. HID lamps can also be designed to produce ultraviolet ("UV") or infra-red ("IR") radiation for applications with similar performance requirements.

A conventional HID lamp presently has light transmissive envelopes made from quartz or polycrystalline alumina ("PCA", also known as "ceramic" envelopes). In general, image projection applications require the HID lamp with a clear envelope, small arc sizes and narrow light beams. The HID lamp with quartz envelopes generally meets these requirements, however, PCA envelopes are translucent and generally not suitable for image projection and similar applications. The PCA envelope lamp is usually constructed with relatively large gaps as necessary for large light source applications. More recently, the HID lamp envelope has been made from poly-crystalline sapphire ("PCS") which is produced by conversion in place of PCA envelopes. Although PCS envelopes improve light transmissivity and other characteristics of the envelope compared to PCA envelopes, PCS envelopes still have microscopic surface undulations that render them not suitable for most image display projection and related applications. Therefore, the conventional HID lamp continues to rely primarily on quartz envelopes.

The use of a quartz envelope places substantial limits on the conventional HID lamp in terms of meeting the above listed desired features for image projection. For example, the quartz envelope has a relatively low melting temperature, power load factor, thermal conductivity and tensile strength. Such considerations effect the lamp optical efficiency, efficacy, power capacity, size, life and the ability to control flicker. Furthermore, the quartz envelope is permeable to a number of additives, such as sodium or hydrogen, which are important in the spectral tailoring of the emitted light.

The Image Projection Industry has established that a correlated color temperature ("CCT") of 6,500° K ("Dystandard") is the light source spectrum most desirable for image projection because it has a high color rendition index and is close to daylight quality. The conventional quartz envelope HID lamp is generally designed to operate at pressures from about 120 up to a maximum around 200 atmospheres utilizing a fill of pure mercury. However, a high pressure mercury lamp has CCT about 7,000° K to 9,000° K. The light from such HID lamp must be filtered in order to achieve a more compatible CCT however filtering can reduce lamp efficiency by about 30 to 40%. Metal halide additives have typically been added to mercury lamps for the purpose of tailoring the light spectrum to a more desirable CCT ("metal halide" lamps). However, the effectiveness of metal halides is reduced as operating pressure increases to the point of minimal contribution at the maximum current operating pressures for the quartz envelope lamp. A conventional Image projection system uses light sources with a wide range of CCT from a typical 3,000° to 3,300° K tungsten halogen lamps, to 4,000° to 5,000° K for metal halide HID lamps, 5,500° to 6,500° K for short arc Xenon lamps, and over 7,000° K for a mercury lamp.

In the image projection field, the industry has moved steadily in recent years toward utilizing smaller light modulators based upon foundry fabricated silicon wafers, e.g., DMD and LCoS, with diagonals of 0.9 down to 0.5 inches. Such small apertures require that the HID lamp used have arc gaps in the range between 0.8 mm–1.3 mm in order to obtain an efficient optical match between the light emitted by the HID lamp and the aperture optics. As lamp gaps become smaller the efficacy of the HID lamp is reduced and the power that can be supplied to the plasma arc is limited by the envelope material thermal characteristics. In order to increase the efficacy of smaller arc gap lamps, the operating pressure must be increased. However, quartz envelope properties limit the pressure and power load factor that one can use in such HID lamps to about 200 atm and about 20 watts/cm$^2$. Also, in applications such as image projection, lamps must be essentially flicker free. Flicker in an arc lamp is associated parametrically to the lamp bulb size and the fill pressure. Using conventional quartz envelopes, one needs to remain below 200 atm in lamp pressure in order to achieve flicker free operation.

SUMMARY OF INVENTION

The object of the present invention is to improve the efficacy, lifetime and spectral stability of a high intensity discharge ("HID") lamp. The present invention utilizes single crystal sapphire ("SCS") in an envelope of the lamp to replace conventional envelope materials. The SCS envelope lamp according to the present invention may be physically smaller, generate light more efficiently, and produce a plasma with greater luminance and stability than a conventional HID lamp. The SCS envelope lamp may be utilized, e.g., in applications that require a small, powerful light source with a narrow beam width such as image projection, automobile headlamps, fiber optic light sources, and the like.

SCS has substantially superior properties compared to conventional materials (e.g., quartz or polycrystalline alumina) that are utilized in the envelopes of the conventional HID lamp. These properties include higher tensile strength, greater burst pressure resistance, higher softening and melting points, greater thermal conductivity, and a higher power load factor. These advantages allow the SCS envelope lamp according to the present invention to operate at higher pressures and temperatures and produce more usable light per watt of power input. In addition, the superior chemical resistance of SCS permits the use of a broader range of fill gases and additives to produce light in a specific spectrum for the application. For example, for visible light radiation in the 400 nm to 700 nm spectrum, this versatility should allow correlated color temperatures to be set and consistently held in a narrow range between 4,000° K to 9,000° K. In addition to visible light radiation, the present invention may also be utilized to produce radiation emissions in the ultraviolet (200–400 nm) and near infra-red (700 nm to about 2,500 nm) spectra with similar benefits.

The SCS envelope lamp may have an effective life four to five times longer than a conventional quartz envelope lamp, even when operating at significantly higher temperatures and pressures. This is accomplished by matching the thermal expansion characteristics of the seal materials and other components to those of the envelope, thereby minimizing the stress on the seals. In addition, the SCS envelope lamp may be manufactured to tighter tolerances with greater consistency than quartz or polycrystalline alumina, and, by using automated manufacturing techniques, at the same or lower cost.

The plasma in the SCS envelope lamp may be produced in a continuous non-flash mode by providing a constant voltage across two end electrodes in waveforms suitable for high pressure operations. The SCS envelope lamp may utilize direct or alternating current. In another embodiment, the SCS envelope lamp may be without electrodes and powered by microwaves or radio frequency radiation. Alternatively, the SCS envelope lamp may be operated as a hybrid using both electrodes and microwave power.

Table 1 is a comparison of sapphire to quartz;

Table 2 is a comparison of tensile strength at various temperatures of quartz and sapphire; and Table 3 is a comparison of thermal conductivity between quartz and sapphire.

DETAILED DESCRIPTION OF THE INVENTION

Embodiments of the present invention will be described in detail with reference to the accompanying drawings.

The present invention describes a HID lamp with a SCS envelope and a method for manufacturing the envelope. Such SCS envelope lamp may be optimized for applications in the visual light range as well as in the UV or IR range of the radiation spectrum.

Structural integrity of the SCS envelope lamp depends upon the physical characteristics of the envelope and end plug materials and the effectiveness of the seals. The envelope and end plugs of the present invention may be manufactured to close tolerances for a consistent fit. The necessary holes in the end plugs for the electrode leads may be produced by conventional or laser drilling or by utilization of small diameter SCS tubing. The SCS envelope lamp according to the present invention may preferentially be assembled using seal materials with similar thermal expansion characteristics to the SCS components, such as nanostructured alumina silicate, in order to minimize stress related failure that results from the lamp heating and cooling cycle. These seals may operate at temperatures above 1,000° K as compared to seal temperatures of about 500° K for quartz. The abrasion resistance and strength of the SCS components, and consistently close component tolerances, makes possible low cost, automated lamp assembly techniques, not possible with quartz or PSA envelope lamps.

Figure 1A:
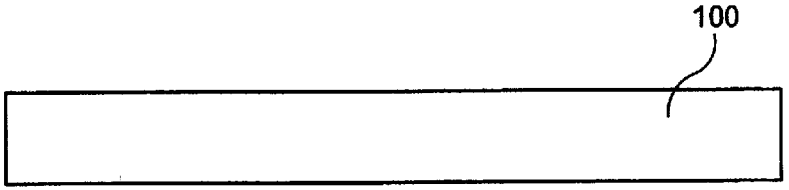
FIG. 1A is a top view of an envelope of a lamp according to the present invention.
Figure 1B:
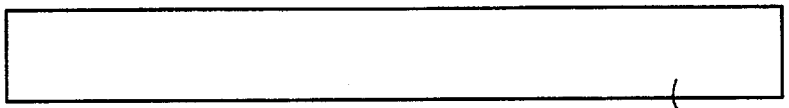
FIG. 1B is a side view of the envelope illustrated in FIG. 1A.
Figure 1C:
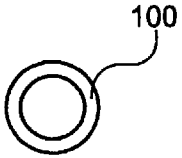
FIG. 1C is an end view of the envelope illustrated in FIG. 1A.

FIG. 1A shows a top view of a SCS hollow tube envelope 100. An inner diameter d of the envelope 100 may range from 1 mm to more than 20 mm, while an outside diameter D of the envelope 100 may range from 2 mm to more than 23 mm. The length L of the envelope 100 may range from 3 mm to more than 400 mm.

SCS properties are compared with quartz and polycrystalline alumina in Table 1. The tensile strength of SCS is compared with quartz as a function of temperature in Table 2. The thermal conductivity of SCS is compared with quartz as a function of temperature in Table 3.

SCS is an anisotropic monoaxial crystal that may be produced in tubular form from the crystallization of pure aluminum oxide using the edge defined film growth technique ("EFG") or similar crystal growing methods. SCS is one of the hardest and strongest known materials, chemically inert, with excellent optical and dialectical characteristics and thermal stability up to 1,600° Celsius. Its wide optical transmission range of 0.17 to 5.5 mkm makes it ideal for production of envelopes for transmission of ultraviolet ("UV"), visible, and infra-red ("NIR") light. SCS is also insoluble in hydrofluoric, sulphuric and hydrochloric acid, and most important for HID lamp applications, it does not outgas or divitrify. The operating temperature of SCS higher than quartz and SCS has significantly higher thermal conductivity. Raw SCS tubing is presently available from a number of vendors, such as Saphikon and Kyocera. Commercial and SCS tubing, as delivered, has problems with holding circular cross-section tolerances. This can be taken care of by appropriate machining of the appropriate surfaces, i.e., reaming the interior and polishing the exterior using diamond tooling to obtain a uniform and specified wall thickness. The SCS envelope may tolerate a higher outer surface temperature than quartz and may handle conduction heat flux of greater than 150 watts/cm$^3$ compared to the 20 watts/cm$^3$ of quartz in the HID lamp applications.

Figure 2A:
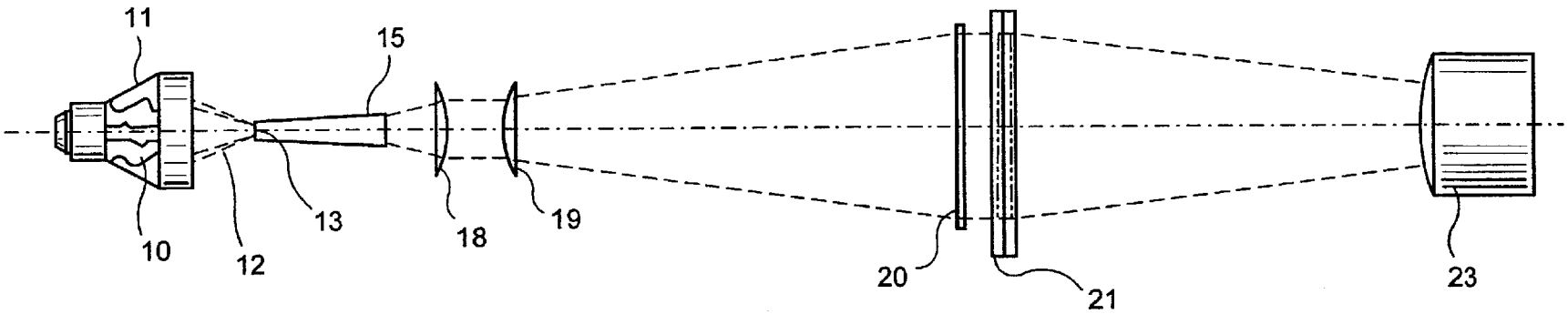
FIG. 2A is a side view of an LCD projector system using a SCS envelope lamp.

FIG. 2A shows an optical projection system having the SCS envelope lamp 10 with a reflector 11. The light of the SCS envelope lamp 10 is focused on an entry face 13 of a hollow light pipe 15, preferably of the type described in U.S. Pat. No. 5,829,858 which is incorporated by reference. The beam is focused by lens 18 and 19 onto a Fresnel plate 20 and a LCD plate 21 which forms an image. The image is focused on the screen by projector lens 23.

Figure 2B:
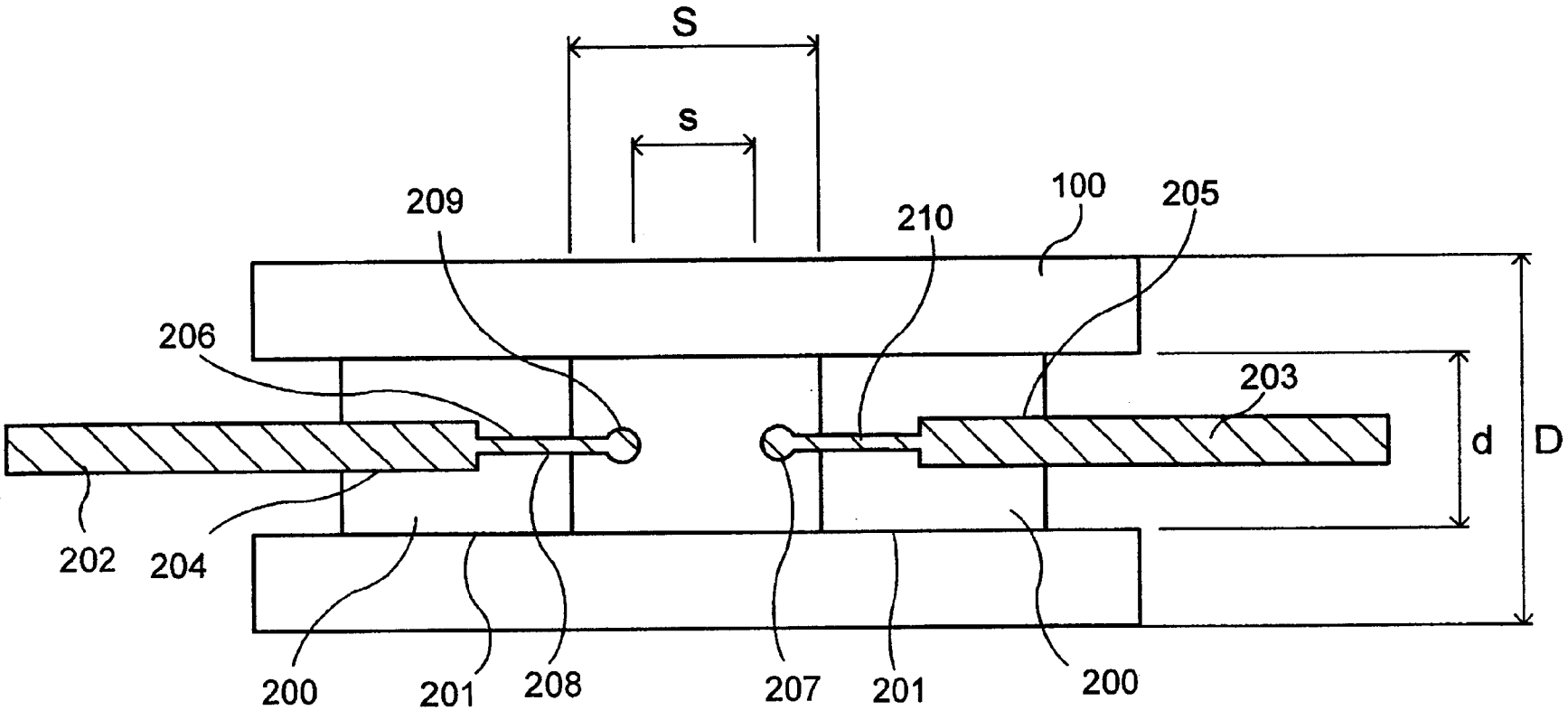
FIG. 2B is a cross-sectional view of a first exemplary embodiment according to the present invention of the envelope which utilizes electrodes.

FIG. 2B is a side view cross-section of the SCS envelope lamp 10. One exemplary method of sealing the plugs 200 to the tubing is to use techniques for sealing PCA plugs to PCA tubing as described, e.g., in U.S. Pat. No. 5,424,608. In FIG. 2B, the envelope 100 is used. The plugs 200, which preferably are made of PCA or SCS, close off the ends of the envelope 100. The plugs 200 are sealed to the envelope 100 with a halide resistant seal material to form a pressure and chemical resistant seal and contain the gases inside the region bounded by the inside diameter d and the surface facing the discharge of the plugs 200. The halide resistant seal material may be composed from materials, e.g., including aluminum, titanium or tungsten oxides as available from vendors, such as Ferro Inc. of Cleveland. The melting point of such materials may be about 800° C. to 1,500° C., and most preferably about 1,200° C., to 1,400° C.

Electrode bases 202, 203 may be fitted into the electrode base receptacles 204, 205 with sufficient clearance for wetting by the fill glass via capillary action. The electrode bases 202, 203 may be composed of niobium or tantalum and have coefficients of expansion close to that of sapphire ($8\times10^{-6}$ K$^{-1}$). An electrode stem 206 may be attached to the electrode base 202 by welding. An electrode stem clearance hole 208 is sufficiently large to allow emplacement of the electrode stem 206, 210 with clearance too small to allow wetting of the clearance hole 208 by the glass sealing material through capillary action.

The filling of the discharge volume takes place prior to insertion of the electrode stems 206, 210. Spherical electrode tips 207, 209 may be formed after assembly by heating with lasers or by drawing high current through the discharge. After assembly, the glass seal is applied by melting glass into the space between the electrode base receptacle 204 and the electrode base 202.

Another exemplary filling method for feeding the mercury, noble gases and other potential fills may be used to manufacture the electrode bases 202, 203 as hollow tubes with an exit opening into the space between the electrode stem 206 and the plugs 200. Upon filling, the exit opening may be sealed with a high melting point solder. The solder may be melted with a laser beam projecting through the hollow tube.

Polycrystalline alumina plugs contain multiple small crystals which present a variety of different crystal faces with respect to the surface of the seal boundary. The coefficient of thermal expansion of each crystal with respect to its boundaries is a function of the crystal orientation. Thus, the expansion and contraction due to thermal cycling of the lamp when it is turned on and off is different for each crystal orientation with respect to the seal boundary. These different rates of expansion and contraction lead to degradation of the seals with thermal recycling.

Figure 8A:
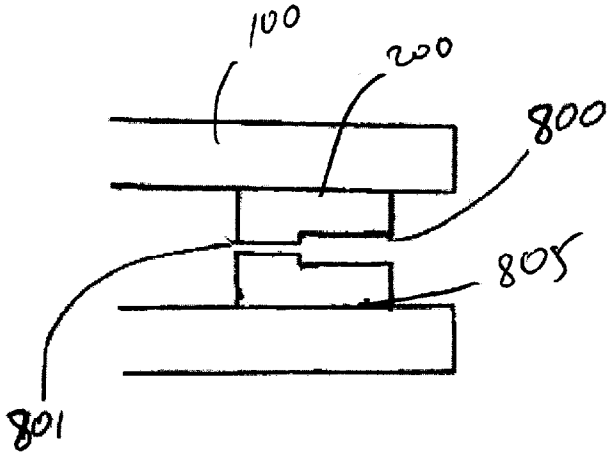
FIG. 8A shows an exemplary embodiment of end plugs of the SCS envelope lamp.
Figure 8B:
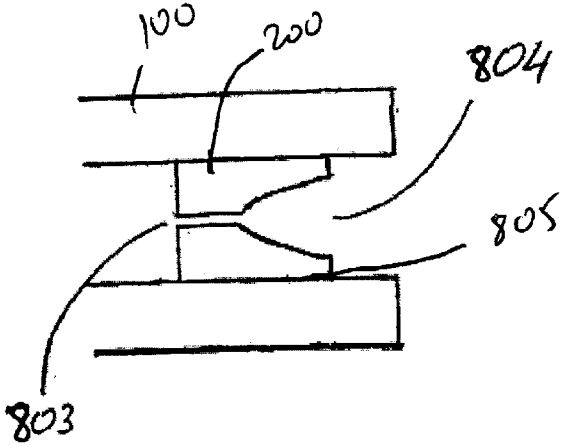
FIG. 8B shows another exemplary embodiment of the end plugs of the SCS envelope lamp.

SCS plugs are preferable to polycrystalline alumina plugs. In particular, if the long axis (the C axis) of the plugs 200 is oriented parallel to the long axis (the C axis) of the envelope 100, then there is no relative change in dimensions of the seal which is beneficial for long life with thermal cycling. The plugs 200 may be shaped as shown in FIGS. 8A and 8B. A cylindrical opening 800 may be machined to be approximately 0.02 mm larger than the electrode bases 202, 203. A hole 801 may be sized to be approximately 0.3 mm in diameter greater than the electrode stems 206, 210. In particular, the electrode bases 202, 203 are fitted into the larger openings 800, 804 with sufficient clearance for wetting the fill glass via capillary action. The electrode bases 202, 203 may be composed of niobium or tantalum which may have coefficients of expansion close to that of sapphire ($8\times10^{-6}$ K$^{-1}$). The electrode stem 206 may be attached to the electrode base 202, e.g., by welding. The clearance holes 801, 803 are sufficiently large to allow emplacement of the electrode stems 206, 210 with clearance too small to allow wetting of the clearance hole 800 by the glass seal through capillary action.

An exemplary method according to the present invention of sealing the plugs 200 to the envelope 100 is to machine and polish the two adjacent surfaces so that a sealing region 805 which is situated therebetween is less than 0.02 mm. This may be accomplished with grinding or laser shaping with a final polishing step. For example, the outer surface of the plugs 200 may be coated with about 1–5 layers of nanostructured alumina silicate with a 1% to 5% mixture of Titanium-dioxide ($TiO_2$). These materials may be obtained from Baikowski Corporation of New Jersey. The coating process may be preformed utilizing a flame spraying or electrostatic deposition. The sealing region 805 may be heated with a laser or centered in an oven to complete the sealing operation.

The opening 804 and the hole 803 may be machined with a high-speed drill or be shaped with a laser as shown in FIG. 8B. For example, the laser that may drill such a shaped opening is a 157 nm F2 laser light. The space between the electrode base 202 and the openings 800, 804 may be filled with (a) a glass frit for a lower temperature operation or (b) the nanostructured alumina-silicate for a higher temperature operation. The final sealing step is to sinter the assembly in an oven or with a laser sintering system. Sintering temperatures may be, for example, 1,700° C. to 2,000° C. The seal made with nanostructured alumina-silicate may be especially useful for long life under thermal cycling because aluminum oxide is used as the basic material to grow SCS.

This SCS envelope lamp 10 may be filled with a greater variety of halides and background gases than those fills which can be used in quartz lamps. For example, scandium and rare earth halides may be used, with their favorite spectrum in the optical region. In quartz envelopes, such halides form reactions that lead to deposition of the silicon on the thoriated tungsten electrode and depletion of the scandium or rare earth fills. See, for example, Waymouth, J. F., "Electric Discharge Lamps," MIT Press, Cambridge, Mass., 1971.

In addition, fills such as sulfur, sodium, hydrogen and chlorine can be used. Utilization of the envelopes, in combination with the various fills, may more than double lamp efficacy to about 120 L/w to 180 L/w for arc gaps in the range between 1 mm and 2 mm. This improvement is due to increased plasma luminance. Lumen maintenance is improved dramatically and the life of the lamp is extended to four or five times that of fused quartz envelope lamps.

FIG. 2B illustrates another exemplary embodiment of the SCS envelope lamp according the present invention which has a short arc. This embodiment may be particularly useful for image projection systems where the arc gap must be optically matched to the size of the image generation device. The arc gap required for current projection systems is generally less than 2 mm with gaps as small as 0.8 mm required for the latest generation of reflective image devices, 0.5" diagonal.

Short mercury arc HID lamps with quartz envelopes, which have been optimized to gap length s of 1.8 mm and inside diameter d of 3.8 mm with fill densities between 40 and 65 mg/cm$^3$ operating at 70 to 150 watts are limited to about 70 L/w output and are subject to "flicker" and premature failure of the quartz envelope due to devitrification. (See, for example, U.S. Pat. No. 5,239,230). Halide versions of such lamps are limited to about 70 L/w with limitations due to the physical properties of the quartz envelope.

A mercury filled HID lamp is described, e.g., in U.S. Pat. No. 5,497,049. This patent describes, for example, that with an inside diameter d of less than 3.8 mm and a power level of 70 to 150 watts, an outside diameter, D, of 9 mm and a pressure of 20 atm, the inside of the quartz begins to liquefy and devitrify leading to premature failure in less than 100 hours.

Quantitative analysis of the above-optimized quartz lamps is as follows:

The data for quartz from Table 2 and Table 3 are used to parameterize the temperature behavior of the thermal conductivity and the tensile strength of the materials. The geometry of the lamp and the input parameters of pressure, power and fill amount of Mercury (Hg) and Xenon (Xe) and other gases are taken from U.S. Pat. No. 5,497,049. The temperature drop across the tube wall is calculated as follows:

$$\Delta T = qWT/k$$

where:

ΔT=temperature drop between inner and outer wall, q=heat flux in watts/square cm, WT wall thickness in cm, and k=thermal conductivity in watts/cm-K.

The total mechanical stress on the tube wall is determined by summing the thermal stress due to the temperature gradient and the mechanical hoop stress. The thermal stress on the low temperature surface on the tube is given by:

$$\sigma(\text{thermal}) = \alpha E(\Delta T/2(1-\mu))$$

where:

α=coefficient of thermal expansion

E=Young's modulus

μ=Poisson's ratio.

The Hoop Stress is given by:

$$\sigma(\text{hoop}) = \text{pressure } d/(2WT)$$

where:

Pressure=fill pressure.

When using the following values

WT=2.6 mm d=3.8 mm

L=5 mm

Power=70 watts

Pressure=20 atm $\alpha = 0.5\times10^{-6}$ $E = 11\times10^{-6}$ lb/in$^2$ and when the outside wall temperature of the bulb is 25° C., the inner wall temperature would be 1,400° K which is consistent with their description of failure at that small size of d at 3.8 mm. Under those conditions the total stress on the bulb would be 53% of the maximum stress of 7,000 lbs/in$^2$.

Comparison with SCS under the same conditions and with:

$a = 8\times10^{-6}$ $E = 11\times10^{-6}$ and an outer wall temperature of 25° C. gives an inner wall temperature of 331° K with a total stress on the bulb of 3.9% of the maximum allowable stress.

Figure 3:
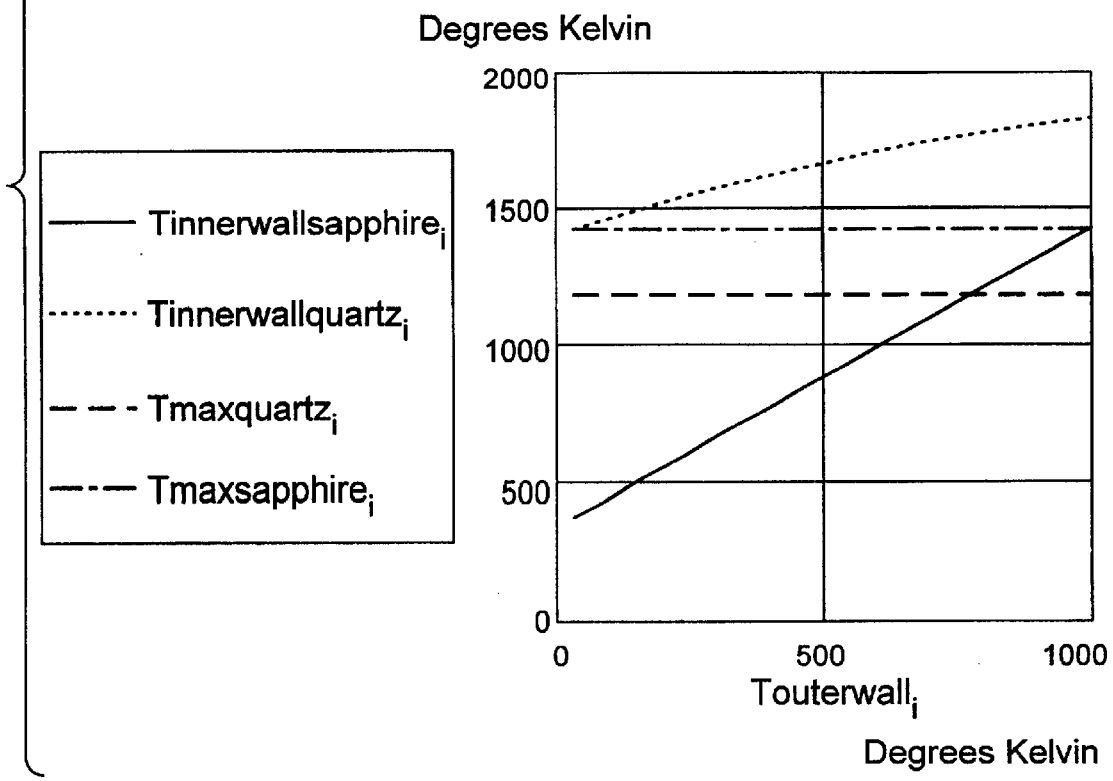
FIG. 3 is a chart comparing heat effect on quartz walls and SCS walls.
Figure 4:
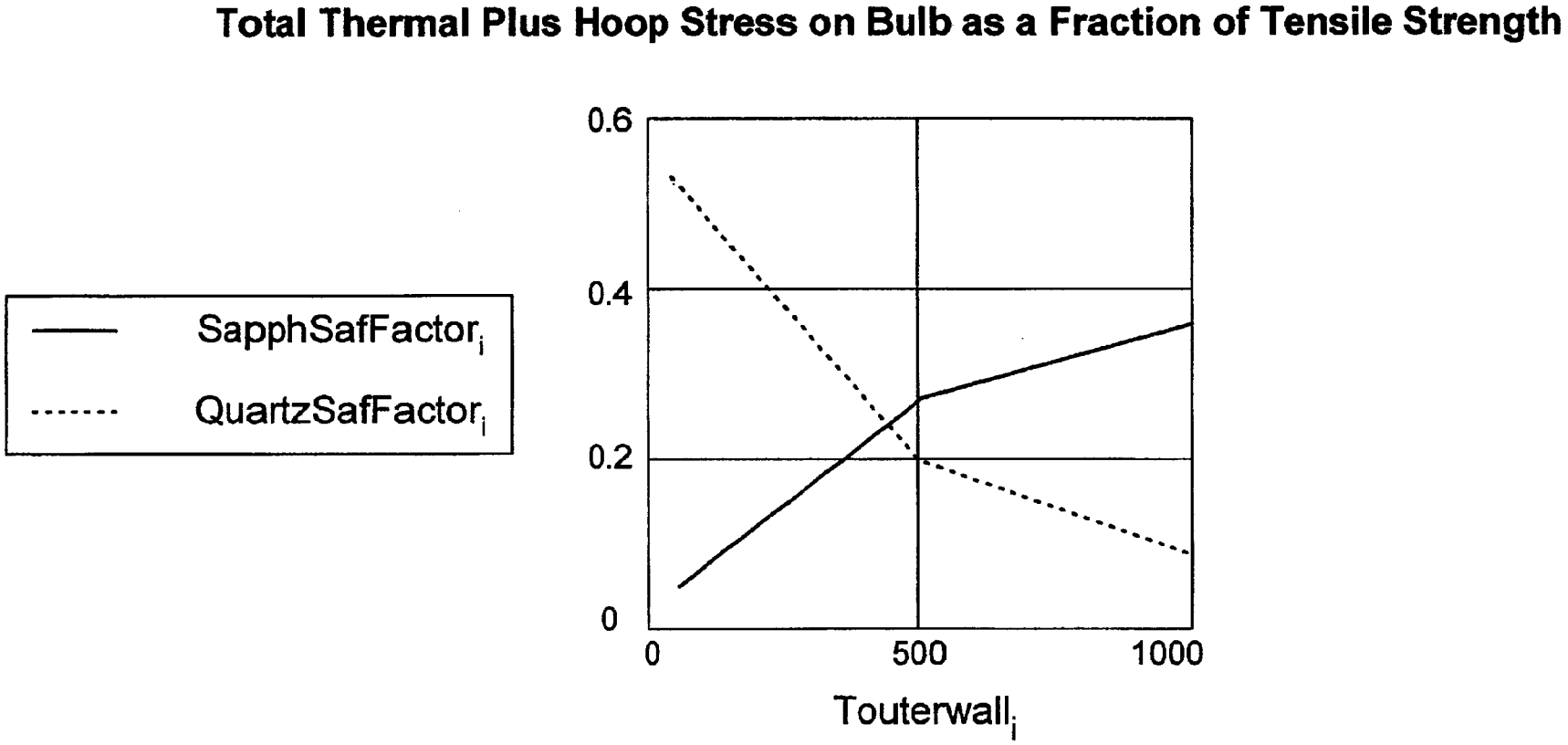
FIG. 4 is a chart showing stress on a bulb as a function of tensile strength.

The SCS envelope lamp is capable of being optimized with improved performance compared to quartz envelope HID lamps. FIG. 3 shows the inner wall temperature of quartz and SCS envelope lamps compared as a function of the outer wall temperature. Note that up to 1,273° K the inner wall temperature stays within safe limits for the SCS envelope lamp, while the quartz lamp fails at room temperature. FIG. 4 is the safety factor defined as the actual total stress/maximum tensile strength. This factor should be a maximum of 0.3 to 0.4 for safe operation. Note that the quartz lamp would fail at room temperature, but that the sapphire lamp stays within feasible operating limits up to 1,273° K.

For example, with an inner diameter of 1.6 mm and an outer diameter of 3.2 mm, the SCS envelope lamp, operating at 150 watts and a pressure of 200 atm, would have an inner wall temperature of 317° C. when the outer wall temperature is 25° C. and an inner wall temperature of 880° C. when operating at an outer wall temperature of 800° C. The safety factor would be 0.064 at 25° C. outer wall temperature and 0.363 at 800° C. outer wall temperature. When operating at 600 atm, the safety factor would be 0.083 at 25° C. outer wall temperature and 0.412 at 800° C. outer wall temperature.

Improved efficacy of light output, with gap sizes between 1 mm and 2 mm is desirable, especially in projector lamps. By allowing operation at higher fill pressures, the stronger SCS tubing allows higher power density and thus higher efficacy. For example, the mercury HID quartz lamp described in U.S. Pat. No. 5,497,049 described an increase in efficacy from 17 L/w at pressures of about 20 atm to 70 L/w at pressures of 50 atm, with roughly a square root dependence on pressure. Basically, increased pressure resulted in increased efficacy until the discharge went unstable.

The pressure at which the discharge goes unstable is determined by the Grashof number:

$$Gr = c\pi^2(d/2)^3(\text{pressure})^2$$

where:

pressure=mercury content in mg/cm$^2$ c=9.86

(Note that 1 mg/cc of mercury is equivalent to 1 atm at 25° C.).

In quartz HID lamps in this range Gr must be less than 1,400 for stable operation. It can be seen from this relationship that a lamp with the inner diameter d greater than 3.8 mm would have a value of Gr greater than 1,400 and would be unstable at mercury contents greater than 60 mg/cc.

The envelope, in the SCS envelope lamp 10 design shown in FIGS. 2A and 2B, may prevent "flicker" at smaller diameters and much higher pressures. For example, a SCS envelope lamp with a value d of 2 mm and an arc gap s of 1.4 mm and a chamber length S of 3 mm would have a value of Gr less than 1,400 for pressures of 120 to 135 mg/cc. This may result in flicker-free operation in this pressure range.

For example, the SCS envelope lamp having the inner diameter d of 1.6 mm and operating at 400 atm would have a Grashof number of about 800 which is within the stability limits.

The Grashof number defines a plasma arc stability condition. It is based on the ratio of a buoyancy force to a viscous force and defines the stability boundary for the gas dynamic forces set up by the arc discharge plasma and its environment. Other factors can help determine whether or not a specific plasma arc actually goes unstable and "flickers". For example, the electrode tip design can be modified to diminish "flicker" by adjusting the supply of electrons to the arc and by modifying the electric field structure at the base of the arc.

The time dependence of the plasma arc temperature and electron number density profile can also influence the development of a plasma instability and thus "flicker". The time dependence of the applied voltage (waveform) determines the time dependence of the plasma arc temperature and number density profile. Suitable variations in these waveforms can diminish flicker.

The SCS envelope lamp according to the present invention, because of the relatively small ratio of an inner wall diameter to an arc length, may operate in a "wall stabilized" mode. In other words, "wall stabilization" may be used as a description of a plasma arc operating with a low Grashof number, because the Grashof number is proportional to the cube of the diameter, making small values of diameter beneficial.

The SCS envelope lamp according to the present invention may be broadly described as operating in a "continuous non-flash" mode. Operating ranges, that may be utilized for the SCS envelope lamps according to the present invention, may include applied voltages between 0.1 volts and 600 volts and applied currents of between 2 amps and 150 amps. For example, one mode of "continuous non-flash" operation is to apply a constant voltage between the electrodes. This is called a direct current ("DC") operation. In this case, one electrode is an anode and another one is a cathode.

A second exemplary mode of "continuous non-flash" operation is to apply alternating current ("AC") in which the voltage reverses polarity on a periodic time dependent basis. The SCS envelope lamp according to the present invention may operate, for example, with time dependent reversal frequencies which can vary between 16 cycles per second to over 1,000 cycles per second. Some of these alternating waveforms can be "sinusoidal" and others could be "square waves".

Efficacy is also much improved for SCS envelopes. Based on the increase in efficacy with pressure described in U.S. Pat. No. 5,497,049, the performance of this HID lamp may be extrapolated to be in the range of 70 L/w to 90 L/w. Thus, improvements in efficacy into the range of 90 L/w may be achieved with mercury fill lamps alone. Further increases of efficacy may be expected by filling the bulb with alternative elements such as sodium, sulfur and selenium. These elements all increase luminous efficiency and can be expected to further increase output in other versions of the SCS lamp.

Figure 5:
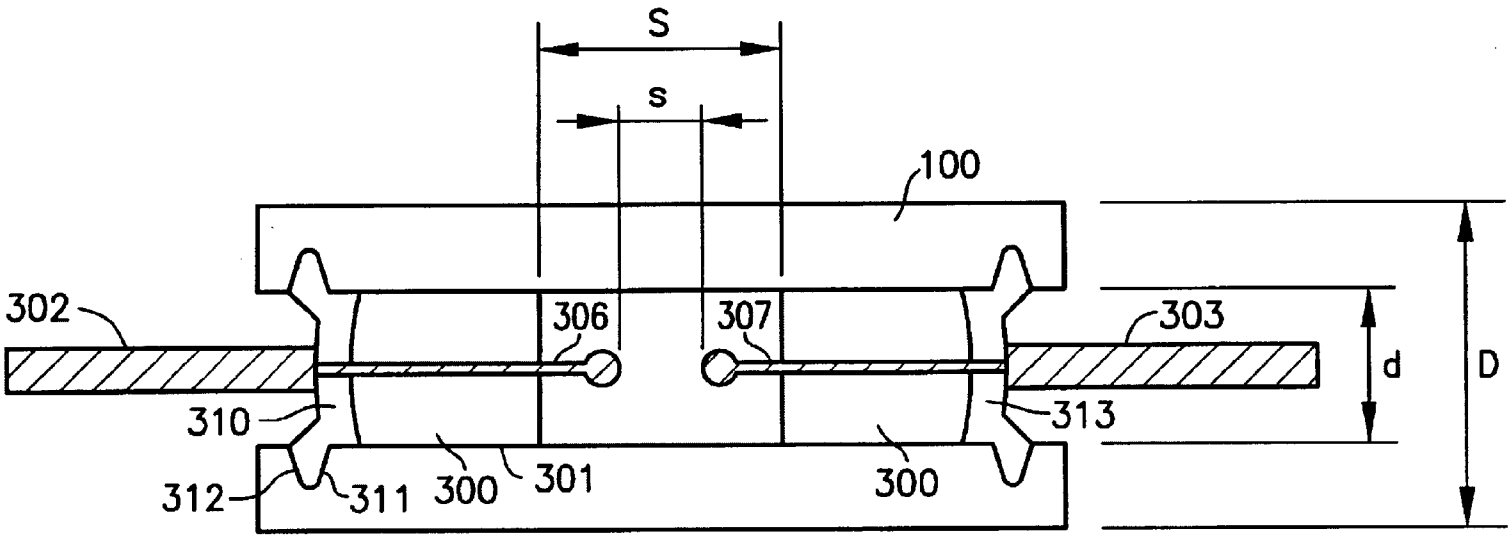
FIG. 5 is a cross-sectional view of a second exemplary embodiment according to the present invention of the envelope which utilizes electrodes.
Figure 6:
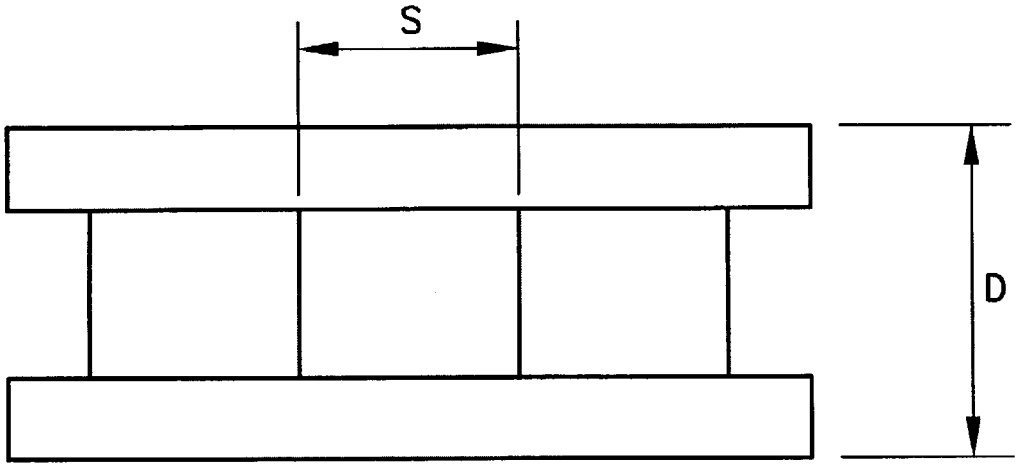
FIG. 6 is a cross-sectional view of a third exemplary embodiment according to the present invention of the envelope which does not utilize electrodes.

A larger SCS envelope lamp which develops considerable pressure on the end plugs, may be built with the design shown in FIG. 5. In FIG. 5, a second metallic barrier is built into the SCS envelope lamp. This second barrier utilizes a new seal geometry in which the pressure from the SCS envelope lamp is taken in compression on the seal face rather than in tension, as in the design shown in FIGS. 2A and 2B. FIG. 5 is a side cross-section of the SCS envelope lamp. In the case the design shown in FIG. 5, the envelope 100 is used and the two plugs 300, preferably are made of PCA or SCS, to close the ends of the envelope 100 as a "first" seal. The plugs 300 are sealed to the envelope 100 to form a pressure and chemical resistant seal and contain the gases inside the region bounded by the inside diameter d and the surface facing the discharge of the plugs 300. The plugs 300 are sealed to the envelope 100 with q halide resistant glass 301 to form a pressure and chemical resistant seal and to contain the gases. The glass 301 may be made from materials including aluminum, titanium or tungsten oxides available from vendors such as Ferro Inc. of Cleveland. The melting point of such materials may be about 1,300° C. As discussed above, for higher temperature operation an alternative seal technology is to use nanostructured alumina-silicate ceramic doped with titanium or tungsten. The nanostructured material may have dimensions of 50 nm to 1,000 nm.

A "second" seal is provided in this design to further improve the lifetime of the SCS envelope lamp. A "electrode disc" is inserted in a groove in the tubing in such a way that the pressure on the ends is taken in compression by the envelope 100, giving a more stable and pressure-resistant seal. The "first seal" takes the pressure in shear, and as bulb diameter increases the shear resistance of the seal does not scale with the diameter. The "second" seal being under compression can absorb much higher forces without flexing or tearing. The pressure from the plasma results in a compressive force on the second seal that is taken up by the tensile strength along the C axis of the envelope 100.

The second seal is preferably formed as follows. An electrode base 302 is welded into the electrode disc 310. An electrode stem 306 is also welded into the electrode disc 310 as shown. The electrode base 302 may be composed of nickel or molybdenum. The electrode disc 310 may be composed of niobium or tantalum which have coefficients of expansion close to that of SCS ($8\times10^{-6}$ $K^{-1}$). The subassembly consisting of the electrode base 302, the electrode disc 310, and the electrode stem 306 is tapped into place. The electrode disc 310 is designed to be flexible enough to slip into an electrode seal receptacle 311. Upon assembly the SCS envelope lamp is first filled appropriately and then an electrode disc seal 312 is made with halide-resistant glass doped with titanium and tungsten. Similarly, the electrode end comprises an electrode base 303 welded to an electrode disc 313 and an electrode stem 307.

Niobium is the preferred material for the second seal. Its coefficient of thermal expansion is $7.1\times10^{-6}$ $K^{-1}$. The coefficient of thermal expansion perpendicular to the C axis of SCS is $7.9\times10^{-6}$ $K^{-1}$. Over a 1,200° C. change in temperature this small difference results in less than $1.2\times10^{-3}$ mm differential expansion, which reduces temperature cycling problems in the seal.

Figure 7:
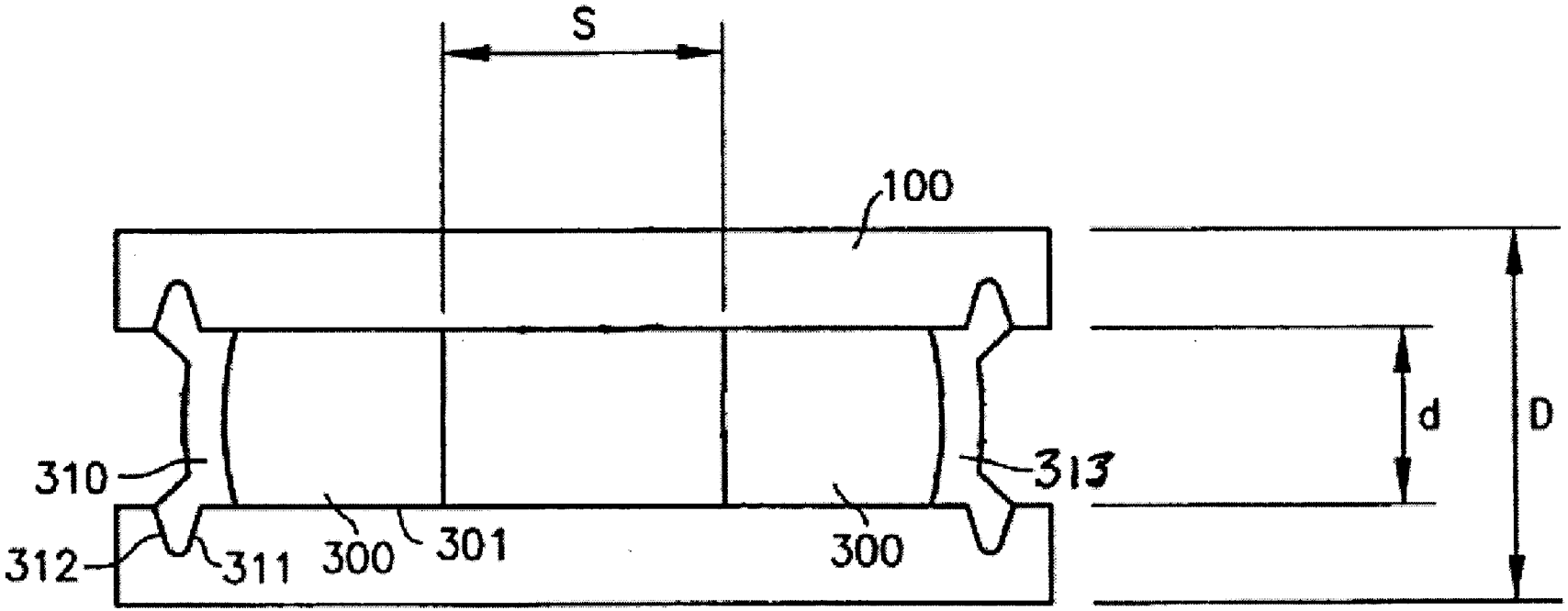
FIG. 7 is a side view cross-section of a SCS envelope electrodeless lamp.

FIG. 7 illustrates another exemplary embodiment of the SCS envelope lamp which does not utilize electrodes. Similarly to the SCS envelope lamp shown in FIG. 5, the electrode disc 310 and the electrode disc 311 are retained, but the electrode base 302, the electrode stem 306 and the electrode stem 303 and the electrode stem 302 are not present in the SCS envelope lamp shown in FIG. 7. This assembly may be fitted into an electrodeless lamp receptacle, and the receptacle can be designed to apply microwave or RF power without the creation of electrical arcs on the metallic components.

This type of electrodeless SCS envelope lamp has advantages over the conventional quartz technology in typical commercial electrodeless lamp applications. In particular, the high temperature capability of the envelope allows operation of the bulb at power densities much greater than 50 watts/cm$^3$ without rotation.

This design utilizes the disc seal concept as described above and shown in FIG. 5, but only as a sealing device. This allows construction of a robust electrodeless lamp capable of operation at pressures over 300 atm.

The electrodes may be adapted for A.C. operation. Their shape and size would be changed for D.C. or pulsed operation. The SCS envelope lamp of the present invention may maintain a CCT of between 6,500° K and 7,000° K with continuous non-flash operation.

Preferably, the envelope 100 has a substantially cylindrical shape with an inner diameter d of between 1 mm and 25 mm and an outer diameter D of 2 mm or more. The fill mercury density is between 10 mg/cm$^3$ and 600 mg/cm$^3$; and the operating pressure ranges between 20 atm and 600 atm. The efficacy of light output exceeds 60 L/w and most preferably 75 L/w; the seals are capable of operating up to 1,400° C.; and the arc plasma has a temperature between 4,000 and 15,000° C.

The high pressure (up to 600 atm) regime of operation with a mercury fill is primarily for emission of visible radiation at high efficiency.

For operation in the UV or IR range of the radiation spectrum, the bulb fill material, the discharge plasma temperature and the optimum operating pressure are tailored for the desired spectrum.

For UV in the range of 200 nm to 400 nm, the mercury fill amount is typically 10–20 mg/cm$^3$ and the xenon fill pressure is between 0.5 atm to 20 atm. Dopant atoms and molecules could be one or more of cadmium, iron chloride, iron bromide, chromium chloride, chromium boride or vanadium. These elements are rich in lines between 200 and 400 nm. Operating temperatures of 6,000° K to 7,000° K are typical for UV production. Alternatively, the mercury can be left out entirely and the xenon fill pressure established in the range from 0.5 atm to 200 atm. This pure xenon fill can be operated up to 15,000° K for generation of UV in the 200 nm to 400 nm region. Dopants can also be added to the mercury free xenon fill. This single crystal sapphire bulb can have many applications such as a spot source for UV curing of coatings and inks.

For IR in the range of 700 nm to 2,500 nm, the mercury fill amount is typically 10–20 mg/cm$^3$ and the xenon fill pressure is between 0.5 atm to 20 atm. Dopant atoms could be one or more of cesium, potassium or rubidium which are rich in infrared lines. The arc operates with typical temperatures between 4,000° K and 6,000° K.

The SCS envelope lamp according present invention may have the following advantages over the conventional lamp:

(1) it has better optical efficiency (e.g., matching of the SCS envelope lamp etendue to that of the image gate element);

(2) it has better power efficiency (e.g., referred to as efficacy and measured in L/w);

(3) it has better color rendition (e.g., a High Color Rendering Index);

(4) it may last longer (e.g., four to five times longer) with superior lumen maintenance than a conventional HID lamp;

(5) it has a smaller physical size;

(6) it reduces initial cost;

(7) it reduces operating cost and enhances manufacturing tolerance;

(8) it reduces system cost;

(9) it may allow a flicker free operation at pressures as high as, e.g., 600 atm, thus achieving substantially higher efficacies than the conventional HID lamp with quartz envelope achieves; and

(11) it may be effectively tailored for specific applications; for example, the SCS envelope has a high chemical stability, this allows the use of a wide range of fill additives and gases (e.g., sodium, hydrogen, neon, chlorine, sulfur, selenium, etc.) which cannot be used with conventional quartz envelope lamps, thus allowing the light spectrum to better tailored for an image projection or any other specific application. In addition, the wide range of alternative fill materials may permit the elimination of mercury from the lamp which is particularly desirable in consumer product applications.

Another advantage of the SCS envelope lamp according to the present invention is that it provides an opportunity to use a number of fill additives that cannot be used with conventional quartz envelope HID lamp, and thus allowing the flexibility to tailor the light spectrum to the desired CCT for projection effectively increasing the lamp useful efficacy.

The SCS envelope lamp according to the present invention may be utilized in various industries, for example, in image projectors, automobile headlamps, fiber optic light sources and other non-speciality applications, such as home lighting.

There are many modifications to the present invention which will be apparent to those skilled in the art without departing form the teaching of the present invention. The embodiments disclosed herein are for illustrative purposes only and are not intended to describe the bounds of the present invention which is to be limited only by the scope of the claims appended hereto.

What is claimed is:

1. A high intensity discharge lamp, comprising:

(a) a lamp bulb envelope composed of single crystal sapphire tubing, the envelope having a tubular burst pressure of at least 4,500 psi at 1,400° C. and a maximum tensile strength of 56,000 psi at 1,400° C., the lamp bulb envelope being substantially cylindrical and having an inner diameter of between 1 mm and 25 mm and an outer diameter of at least 2 mm;

(b) a plurality of end plugs composed of one of polycrystalline alumina and single crystal sapphire, the end plugs being situated at opposite ends of the lamp bulb envelope;

(c) first and second electrodes extending through the end plugs so that at least a portion of each of the first and second electrodes is situated within the lamp bulb envelope;

(d) a seal sealing each of the end plugs to an inside wall of the corresponding end of the lamp bulb envelope; and (e) a fill situated within the lamp bulb envelope, wherein a voltage is applied to the first and second electrodes to generate an arc plasma therebetween, the voltage being provided by a power supply operating in a continuous non-flash mode, and wherein the arc plasma emits a visible radiation spectrum between 400 nm and 700 nm with a color temperature between 4,000° K and 9,000° K.

2. The lamp according to claim 1, wherein the fill is composed of at least one of mercury and xenon.

3. The lamp according to claim 1, wherein the tubing is without microscopic surface undulations arising from conversion in place from polycrystalline alumina.

4. The lamp according to claim 1, wherein the end plugs are composed of polycrystalline alumina and the seal is composed of glass doped with one of titanium and tungsten.

5. The lamp according to claim 1, wherein the end plugs are composed of single crystal sapphire and wherein a long axis of the end plugs is the C axis which is parallel to C axis of the lamp bulb envelope.

6. The lamp according to claim 1, wherein the end plugs are composed of single crystal sapphire, wherein a clearance distance between the end plugs and the lamp bulb envelope is less than 0.2 mm.

7. The lamp according to claim 1, wherein a surface of the end plugs is coated with a seal material composed of at least one layer of nanostructured alumina-silicate which has between 1% and 5% mixture of titanium dioxide.

8. The lamp according to claim 1, wherein a sealing region is between the lamp bulb envelope and each of the end plugs, the sealing region being sintered between 1,700 and 2,000° C.

9. The lamp according to claim 1, wherein the end plugs are composed of single crystal sapphire, the end plugs having corresponding integral holes for insertion of the first and second electrodes.

10. The lamp according to claim 9, where the holes are prepared in a stepped manner, each of the holes having a first portion and a second portion, the first portion facing an inside of the lamp bulb envelope, the second portion facing outside of the lamp bulb envelope, the first portion having a smaller diameter than the second portion.

11. The lamp according to claim 9, wherein the holes are generated using a drilling procedure with a laser in the 147 nm or less regime.

12. The lamp according to claim 10, wherein each of the first and second electrodes having an electrode stem and an electrode base, the stem being inserted into the lamp bulb envelope through the first portion of the hole, the electrode base being fitted in the second portion of the hole.

13. The lamp according to claim 1, wherein an operating temperature of the seals is between 600 and 1400° C.

14. The lamp according to claim 1, wherein an inner diameter of the lamp bulb envelope is between 1 mm and 2 mm and the Grashof number is less than 1400.

15. The lamp according to claim 2, wherein a mercury density of the fill is between 20 and 600 mg/cm$^3$ and a xenon pressure is between 0.6 atm and 10 atm.

16. The lamp according to claim 1, wherein an operating pressure of the lamp is between 20 atm and 600 atm.

17. The lamp according to claim 1, wherein the correlated color temperature is determined as a function of a type of dopants utilized in the fill, the type of dopants corresponding to a particular application of the lamp, and wherein the correlated color temperature is maintained over a life of the lamp.

18. The lamp according to claim 1, wherein the fill includes a mercury-free fill.

19. The lamp according to claim 18, wherein the fill includes at least one of scandium and rare earth halides.

20. The lamp according to claim 1, wherein an efficacy value of the lamp exceeds 60 lumen per watt.

21. The lamp according to claim 1, wherein the first and second electrodes are separated a predetermined distance, the predetermined distance being less than 2 mm.

22. The lamp according to claim 1, wherein a total radiation flux within the lamp bulb envelope is between 100 and 150 watts/cm$^2$.

23. The lamp according to claim 9, wherein each of the end plugs is composed of a single crystal sapphire tube, the tube being generated by an edge grown crystallization process with the integral hole for insertion of the first and second electrodes.

24. The lamp according to claim 1, wherein the power supply operates in a voltage range between 0.1 volt and 600 volts and a current range of between 2 amps and 150 amps.

25. The lamp according to claim 1, wherein the power supply is a direct current power supply.

26. The lamp according to claim 1, wherein the power supply is an alternating current power supply.

27. The lamp according to claim 1, wherein the power supply operates with frequency in a range of between 16 cycles per second and over 1,000 cycles per second.

28. A high intensity discharge lamp, comprising:

(a) a lamp bulb envelope composed of single crystal sapphire tubing, the envelope having a tubular burst pressure of at least 4,500 psi at 1,400° C. and a maximum tensile strength of 56,000 psi at 1,400° C., the lamp bulb envelope being substantially cylindrical and having an inner diameter of between 1 mm and 25 mm and an outer diameter of at least 2 mm;

(b) a plurality of end plugs composed of one of polycrystalline alumina and single crystal sapphire, the end plugs being situated at opposite ends of the lamp bulb envelope;

(c) first and second electrodes extending through the end plugs so that at least a portion of each of the first and second electrodes is situated within the lamp bulb envelope;

(d) a seal sealing the each of end plugs to an inside wall of the corresponding end of the lamp bulb envelope; and (e) a fill situated within the lamp bulb envelope, wherein a voltage is applied to the first and second electrodes to generate an arc plasma therebetween, the voltage being provided by a power supply operating in a continuous non-flash mode, and wherein the lamp is operated in a particular regime so that the arc plasma emitting radiation in a 200 nm to 400 nm ultraviolet region of a radiation spectrum.

29. The lamp according to claim 28, wherein the fill is composed of at least one of mercury and xenon.

30. The lamp according to claim 28, wherein the tubing is without microscopic surface undulations arising from conversion in place from polycrystalline alumina.

31. The lamp according to claim 28, wherein the fill is composed of xenon and hydrogen.

32. The lamp according to claim 28, wherein the particular regime of the lamp operation is in a temperature range between 9,000 and 15,000° K.

33. The lamp according to claim 28, wherein the particular regime of the lamp operation is in a pressure range between 0.5 atm and 200 atm.

34. The lamp according to claim 28, wherein the lamp bulb envelope is doped with UV emitting fill materials including at least one of iron chloride, iron bromide, chrome chloride, chrome boride, cadmium and vanadium.

35. The lamp according to claim 34, wherein a temperature of the plasma is in the range of 6000 to 7000° K and a pressure of the plasma is in the range of 5 atm to 50 atm for maximum emission of line radiation from dopant atoms between 200 and 400 nm.

36. A high intensity discharge lamp, comprising:

(a) a lamp bulb envelope composed of single crystal sapphire tubing, the envelope having a tubular burst pressure of at least 4,500 psi at 1,400° C. and a maximum tensile strength of 56,000 psi at 1,400° C., the lamp bulb envelope being substantially cylindrical and having an inner diameter of between 1 mm and 25 mm and an outer diameter of at least 2 mm;

(b) a plurality of end plugs composed of one of polycrystalline alumina and single crystal sapphire, the end plugs situated at opposite ends of the lamp bulb envelope;

(c) first and second electrodes extending through the end plugs so that at least a portion of each of the first and second electrodes is situated within the lamp bulb envelope;

(d) a seal sealing each of the end plugs to an inside wall of the corresponding end of the lamp bulb envelope; and (e) a fill situated within the lamp bulb envelope, wherein a voltage is applied to the first and second electrodes to generate an arc plasma therebetween, the voltage being provided by a power supply operating in a continuous non-flash mode, and wherein the lamp is operated in a particular regime so that the arc plasma emitting radiation in 700 to 2500 nm infrared region of a radiation spectrum.

37. The lamp according to claim 36, wherein the lamp bulb envelope is doped with infra-red emitting materials including at least one of cesium, potassium and rubidium.

38. The lamp according to claim 36, wherein a temperature of the plasma is in a range of 4000 to 6000° K and a pressure of the plasma is in the range of5 atm to 50 atm for maximum emission of line radiation from dopant atoms between 700 and 2500 nm.

* * * * *